US009040807B2

(12) United States Patent
Osuga et al.

(10) Patent No.: US 9,040,807 B2
(45) Date of Patent: May 26, 2015

(54) KEYBOARD APPARATUS FOR AN ELECTRONIC MUSICAL INSTRUMENT

(71) Applicant: YAMAHA CORPORATION, Hamamatsu-shi, Shizuoka-ken (JP)

(72) Inventors: Ichiro Osuga, Hamamatsu (JP); Hiroshi Harimoto, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 14/499,498

(22) Filed: Sep. 29, 2014

(65) Prior Publication Data

US 2015/0090103 A1 Apr. 2, 2015

(51) Int. Cl.
*G10H 1/32* (2006.01)
*G10H 1/34* (2006.01)

(52) U.S. Cl.
CPC ..... *G10H 1/34* (2013.01)

(58) Field of Classification Search
CPC ..... G10H 1/34
USPC ..... 84/744
See application file for complete search history.

(56) References Cited

U.S. PATENT DOCUMENTS

| | | | | |
|---|---|---|---|---|
| 7,402,741 | B2 * | 7/2008 | Funaki et al. | 84/423 R |
| 7,750,231 | B2 * | 7/2010 | Nishida et al. | 84/658 |
| 8,624,140 | B2 * | 1/2014 | Nishino et al. | 200/302.2 |
| 8,766,076 | B2 * | 7/2014 | Ishida | 84/433 |

FOREIGN PATENT DOCUMENTS

JP 749512 Y2 11/1995

* cited by examiner

*Primary Examiner* — Jianchun Qin
(74) *Attorney, Agent, or Firm* — Rossi, Kimms & McDowell LLP

(57) ABSTRACT

Reaction force generation members 21*w*, 21*b* are made of elastic body to be shaped like domes, respectively, so that the reaction force generation members 21*w*, 21*b* can be elastically deformed by depression exerted in directions of axis lines Yw, Yb, respectively, to increase their respective reaction forces from the beginning with the increasing amount of elastic deformation to buckle after respective peaks of the reaction forces to reduce the respective reaction forces. By varying the directions of the axis lines Yw, Yb of the reaction force generation members between a white key 11*w* and a black key 11*b*, the respective directions in which the reaction force generation members 21*w*, 21*b* are depressed at the peaks of the reaction forces are made close to the directions of the axis lines Yw, Yb of the reaction force generation members 21*w*, 21*b*, respectively.

8 Claims, 10 Drawing Sheets

KEYBOARD APPARATUS FOR AN ELECTRONIC MUSICAL INSTRUMENT

BACKGROUND OF THE INVENTION

1. Field of the Invention

The present invention relates to a keyboard apparatus for an electronic musical instrument, the keyboard apparatus having reaction force generation members for generating a reaction force by elastically deforming in response to a player's operation.

2. Description of the Related Art

Conventionally, there are keyboard musical instruments such as electronic organs and electronic pianos having rubber-dome reaction force generation members for exerting reaction force against the depression of keys. For example, Japanese Examined Utility Model Application Publication No. 7-49512 discloses a keyboard apparatus having a reaction force generation member (let-off element) on a key frame (shelf board) which supports a key located above the key frame so that the key can pivot. The reaction force generation member is elastically deformed, by being depressed by the key depressed by a player, to generate a reaction force. As indicated in FIG. 14, particularly, the reaction force generation member generates a reaction force having the property of increasing with increasing angle between which the key pivots by a depression of the key, and abruptly decreasing by buckling distortion after the reaction force has reached its peak. By providing the player with a feeling of click brought about by the buckling distortion, the conventional keyboard apparatus provides the player with the key-touch similar to the touch of a piano brought about by let-off.

SUMMARY OF THE INVENTION

However, the above-described conventional keyboard apparatus has a problem that the conventional keyboard fails to provide a player with a uniform key touch both on white keys and black keys, for the feeling of click perceived on a player's depression of a key varies between the white keys and the black keys.

For simplicity of a keyboard apparatus of an electronic musical instrument, in many cases, a pivot axis portion of each key is designed without distinction between white keys and black keys. In such cases, if reaction force generation members of both the white keys and the black keys are arranged at the same position in a front-rear direction (that is, in the direction of the length of the keys), the direction in which the reaction force generation member is depressed by a pivoting key varies between the white keys and the black keys. Furthermore, since the placement of parts of a keyboard of an electronic musical instrument is strictly restricted, with structural restrictions being different between the white keys and the black keys, there are cases where the position of the pivot axis in the vertical direction or in the front-rear direction varies between the white keys and the black keys, or the position of the reaction force generation member in the front-rear direction varies between the white keys and the black keys. In such cases as well, the direction in which the reaction force generation member is depressed by a pivoting key varies between the white keys and the black keys.

As described in the above-described Examined Utility Model Application Publication, however, in a case where a reaction force against a depression of a key is applied by a rubber dome, ideal characteristics of reaction force cannot be obtained unless the rubber dome is depressed in a direction of the axis line of the rubber dome. Particularly, the reaction force characteristics which provide an ideal feeling of click cannot be obtained unless the rubber dome is depressed in the axis line direction at the peak of the reaction force immediately before buckling of the rubber dome. In the cases where the direction in which the reaction force generation member is depressed varies between the white keys and the black keys as described above, therefore, the keyboard apparatuses cannot provide players with uniform key touch on the white keys and the black keys, for the feeling of click varies between the white keys and the black keys. However, no mention about the difference in the key touch between the white keys and the black keys was made in the above-described Examined Utility Model Application Publication.

The present invention was accomplished to solve the above-described problem, and an object thereof is to provide a keyboard apparatus for an electronic musical instrument, the keyboard apparatus providing a player with almost the same key touch both on white keys and black keys by providing almost uniform feeling of click against key-depression both on the white keys and the black keys. As for descriptions about respective constituent features of the present invention, furthermore, reference letters of corresponding components of embodiments described later are provided in parentheses to facilitate the understanding of the present invention. However, it should not be understood that the constituent features of the present invention are limited to the corresponding components indicated by the reference letters of the embodiments.

In order to achieve the above-described object, the present invention provides a keyboard apparatus for an electronic musical instrument, the keyboard apparatus including a plurality of keys composed of a white key (11*w*) and a black key (11*b*), each key pivoting about a corresponding pivot axis so that a front end of the key can move up and down, and a plurality of reaction force generation members (21*b*, 21*w*) which are provided for the plurality of keys, respectively, and each of which is depressed by a depression of a corresponding key to generate a reaction force against the depression of the corresponding key, wherein each of the reaction force generation members is made of an elastic body to be shaped like a dome, and is configured to be elastically deformed by being depressed in an axis line direction to increase the reaction force from a beginning with an increasing amount of elastic deformation to buckle after a peak of the reaction force to reduce the reaction force; and the plurality of reaction force generation members are arranged such that the axis line direction (Yw, Yb) of the reaction force generation members is varied between the white key and the black key so that a direction in which each of the reaction force generation members is depressed at the peak of the reaction force is close to the axis line direction of the reaction force generation member.

In this case, for example, the plurality of reaction force generation members (21*w*, 21*b*) may be placed to face depression portions (11*w*1, 11*b*1) of the keys, respectively, so that the reaction force generation members can be depressed by the depression portions of the keys, respectively, or the plurality of reaction force generation members (21*w*, 21*b*) may be provided on the plurality of keys, respectively, so that the reaction force generation members can be depressed by depression portions (31*ew*, 31*eb*) provided to face the reaction force generation members, respectively. Furthermore, it is preferable that a first angle (θ) between the axis line (Yw) direction of the reaction force generation member corresponding to the white key and the axis line (Yb) direction of the reaction force generation member corresponding to the black key is set to be smaller than double a second angle (ϕ)

between a straight line (Lw) which is situated on a plane orthogonal to the pivot axis of the white key and passes through a depression point of the reaction force generation member depressed by a depression of the white key at the peak of the reaction force and the pivot axis (Cw) of the white key, and a straight line (Lb) which is situated on a plane orthogonal to the pivot axis of the black key and passes through a depression point of the reaction force generation member depressed by a depression of the black key at the peak of the reaction force and the pivot axis (Cb) of the black key. Furthermore, it is further preferable that the first angle is set to be equal to the second angle. For example, furthermore, each of the reaction force generation members gradually increases its reaction force from the beginning with the increasing amount of elastic deformation by the depression exerted in the axis line direction to buckle after the peak of the reaction force to abruptly decrease the reaction force.

Furthermore, for example, the plurality of reaction force generation members (21*w*, 21*b*) may be configured to face respective depression portions (41*w*4, 41*b*4) of a plurality of pivoting bodies (41*w*, 41*b*) operating in conjunction with the plurality of keys, respectively, so that the reaction force generation members can be depressed by the depression portions of the pivoting bodies, respectively, or the plurality of reaction force generation members (21*w*, 21*b*) may be provided on a plurality of pivoting bodies (41*w*, 41*b*) operating in conjunction with the plurality of keys, respectively, so that the reaction force generation members can be depressed by depression portions placed to face the reaction force generation members, respectively. Furthermore, it is preferable that a first angle (θ) between the axis line (Yw) direction of the reaction force generation member corresponding to the white key and the axis line (Yb) direction of the reaction force generation member corresponding to the black key is set to be smaller than double a second angle (ϕ) between a straight line (Lw) which is situated on a plane orthogonal to a pivot axis (Cw1) of the pivoting body corresponding to the white key and passes through a depression point of the reaction force generation member depressed by a pivot of the pivoting body corresponding to the white key at a peak of the reaction force and the pivot axis of the pivoting body corresponding to the white key, and a straight line (Lb) which is situated on a plane orthogonal to a pivot axis (Cb1) of the pivoting body corresponding to the black key and passes through a depression point of the reaction force generation member depressed by a pivot of the pivoting body corresponding to the black key at a peak of the reaction force and the pivot axis of the pivoting body corresponding to the black key. Furthermore, it is further preferable that the first angle is set to be equal to the second angle. In this case as well, furthermore, each of the reaction force generation members gradually increases its reaction force from the beginning with the increasing amount of elastic deformation by the depression exerted in the axis line direction to buckle after the peak of the reaction force to abruptly decrease the reaction force.

In the present invention configured as above, the plurality of reaction force generation members are arranged such that the axis line direction of the reaction force generation members is varied between the white key and the black key so that a direction in which each of the reaction force generation members is depressed at the peak of the reaction force is close to the axis line direction of the reaction force generation member. According to the present invention, therefore, by the depression of the white key and the black key, at respective peaks of the reaction forces immediately before the buckling of the reaction force generation members, the respective reaction force generation members corresponding to the depressed white key and black key are to be depressed roughly in the respective axis line directions. Both on the depression of the white key and on the depression of the black key, therefore, the keyboard apparatus of the present invention can provide a player with the key touch having almost the same feeling of click. In this case, by setting the first angle at a value smaller than double the second angle, the keyboard apparatus can provide almost the same key touch for both the white keys and the black keys to provide the player with favorable key touch. By setting the first angle at a value equal to the second angle, furthermore, the keyboard apparatus can provide the same key touch for both the white keys and the black keys to provide the player with even more favorable key touch.

It is another feature of the present invention that as described above, in the case where the reaction force generation members are depressed by the depression portions of the keys, respectively, or in the case where the reaction force generation members are provided on the keys, respectively, to be depressed by the depression portions placed to face the reaction force generation members, respectively, the respective depression portions of the plurality of keys, or the respective depression portions placed to face the plurality of reaction force generation members are configured such that respective normal lines of depression surfaces of the depression portions of the keys, or respective normal lines of depression surfaces of the depression portions placed to face the plurality of reaction force generation members become parallel to the axis lines of the reaction force generation members at respective peaks of the reaction forces, respectively. It is also the feature of the invention that in the case where the reaction force generation members are depressed by the respective depression portions of the pivoting bodies, or the reaction force generation members are provided on the pivoting bodies, respectively, to be depressed by the depression portions placed to face the reaction force generation members as described above, the respective depression portions of the plurality of pivoting bodies, or the respective depression portions placed to face the plurality of reaction force generation members are configured such that respective normal lines of depression surfaces of the depression portions of the pivoting bodies, or respective normal lines of depression surfaces of the depression portions placed to face the plurality of reaction force generation members become parallel to the axis lines of the reaction force generation members at respective peaks of the reaction forces, respectively.

According to the feature of the invention, at the respective peaks of the reaction forces, respective directions of the normal lines of the depression surfaces of the depression portions coincide with the respective directions of the axis lines of the reaction force generation members, so that the reaction force generation members can be depressed more effectively. As a result, the keyboard apparatus can provide the player with even favorable key touch.

From a different viewpoint, furthermore, it is a further feature of the present invention to provide a keyboard apparatus for an electronic musical instrument, the keyboard apparatus including a plurality of keys composed of a white key (11*w*) and a black key (11*b*), each key pivoting about a corresponding pivot axis so that a front end of the key can move up and down, and a plurality of reaction force generation members (21*w*, 21*b*) which are provided for the plurality of keys, respectively, and each of which is depressed by a depression of a corresponding key to generate a reaction force against the depression of the corresponding key, wherein each of the reaction force generation members is made of an elastic body, and is configured to be elastically deformed by being depressed to increase the reaction force from a beginning with an increasing amount of elastic deformation to buckle after a peak of the reaction force to reduce the reaction force; and the plurality of reaction force generation members are arranged such that a direction in which each of the reaction force generation members exerts a reaction force at the peak of the reaction force is varied between the white key and the black key so that a direction in which each of the reaction force generation members is depressed at the peak of the reaction force is close to the direction in which the reaction force generation member exerts the reaction force.

According to the feature as well, by the depression of the white key and the black key, at respective peaks of the reaction forces immediately before the buckling of the reaction force generation members, the respective reaction force generation members corresponding to the depressed white key and black key are to be depressed roughly in the respective directions of the reaction forces. Both on the depression of the white key and on the depression of the black key, therefore, the keyboard apparatus of the present invention can provide a player with the key touch having almost the same feeling of click.

DESCRIPTION OF THE PREFERRED EMBODIMENT a. First Embodiment

Figure 1:
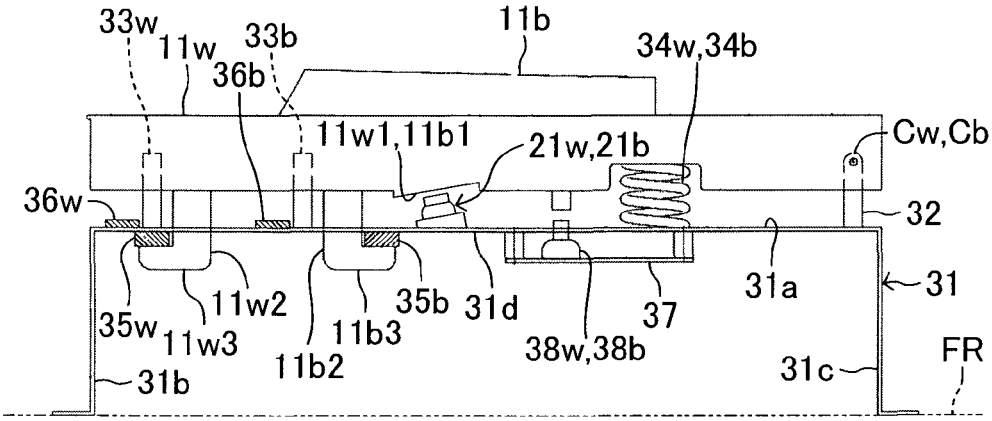
FIG. 1 is a schematic side view of a keyboard apparatus according to the first embodiment of the present invention.
Figure 2:
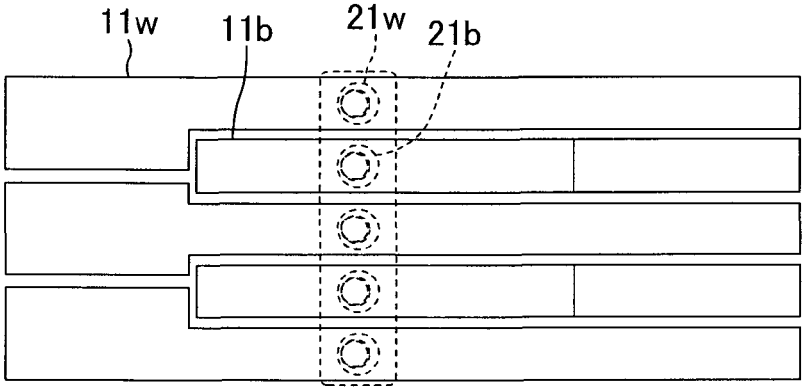
FIG. 2 is a schematic top view of the keyboard apparatus of FIG. 1.

The first embodiment of the present invention will now be described with reference to the drawings. FIG. 1 is a schematic side view indicative of a keyboard apparatus according to the first embodiment seen from the right. FIG. 2 is a schematic top view of the keyboard apparatus. In the drawings of the present invention, the front-rear direction of the keyboard apparatus is defined as the lateral direction, and the vertical direction of the keyboard apparatus is defined as the vertical direction.

The keyboard apparatus has a plurality of white keys 11*w* and a plurality of black keys 11*b* which are to be depressed and released by a player. The keyboard apparatus also has a plurality of reaction force generation members 21*w*, 21*b* each exerting a reaction force against a player's depression of its corresponding key. The white key 11*w* is long in the front-rear direction, has a U-shaped cross-section which is open downward, and is located on a flat upper plate portion 31*a* of a key frame 31. The key frame 31 has flat leg portions 31*b* and 31*c* extending downward at the front end and the rear end of the upper plate portion 31*a*, with respective lower end portions of the leg portions 31*b* and 31*c* being fastened to a frame FR provided within a musical instrument. To the upper surface of the rear end portion of the upper plate portion 31*a* of the key frame 31, a pair of plate-like key supporting portions 32 erected to be opposed with each other inside the white key 11*w* is fastened. On the upper portion of each key supporting portion 32, a projecting portion jutting outward is provided to face each other. The projecting portion of each key supporting portion 32 is inserted into a through-hole provided on the both sides of the rear end portion of the white key 11*w* from inside the white key 11*w* so that the key can rotate. By such a configuration, the white key 11*w* is supported by the pair of key supporting portions 32 so that the white key 11*w* can pivot to allow the front end of the white key 11*w* to move in the vertical direction. Hereafter, the center of the pivoting of the white key 11*w* will be referred to as a pivot axis Cw. The black keys 11*b* are configured similarly to the white keys 11*w*, except that the black keys 11*b* are configured to have a raised upper face of the front portion. Each of the black keys 11*b* is also supported by the key supporting portions 32 so that the black key 11*b* can pivot about a pivot axis Cb to allow the front end of the black key 11*b* to move in the vertical direction. The pivot axis Cb of the black key 11*b* is situated at the same position in the front-rear direction and in the vertical direction as the pivot axis Cw of the white key 11*w*.

On the upper surface of the upper plate portion 31*a* of the key frame 31, a key guide 33*w* is erected to be situated under the front end portion of the white key 11*w*, while a key guide 33*b* is erected to be situated under the front end portion of the black key 11*b*. The key guide 33*w* and 33*b* are inserted into the white key 11*w* and the black key 11*b*, respectively, so that the key guides 33*w* and 33*b* can slide in order to prevent the white key 11*w* and the black key 11*b* from moving in the lateral direction when the keys 11*w* and 11*b* pivot in the vertical direction.

A reaction force generation member 21*w* is provided for each of the white keys 11*w*, while a reaction force generation member 21*b* is provided for each of the black keys 11*b*. The reaction force generation members 21*w* and 21*b* are fastened to the upper surface of the upper plate portion 31*a* of the key frame 31 such that the reaction force generation member 21*w* and 21*b* are situated below a central portion of the white key 11*w* and the black key 11*b*, respectively, in the front-rear direction. In this case, the reaction force generation member 21*w* of the white key 11*w* is located on the same position in the front-rear direction as the reaction force generation member 21*b* of the black key 11*b*, so that the reaction force generation members 21*w* and 21*b* are arranged in a row in the lateral direction of the keyboard. Furthermore, the reaction force generation members 21*w* and 21*b* are integrally formed.

Figure 4A:
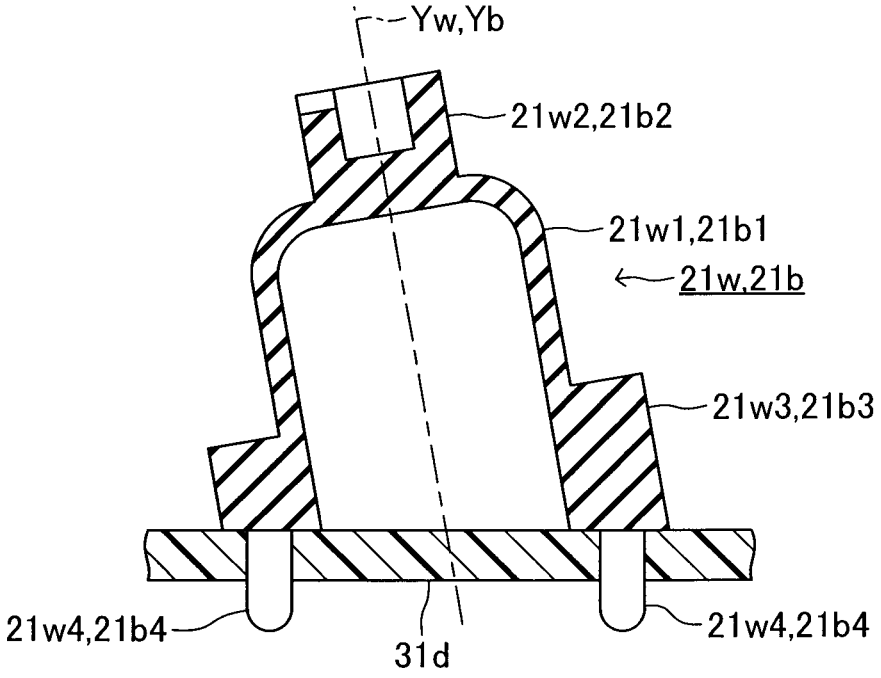
FIG. 4(A) is a cross sectional view of the reaction force generation member at a point in time before the start of a depression of a key.
Figure 4B:
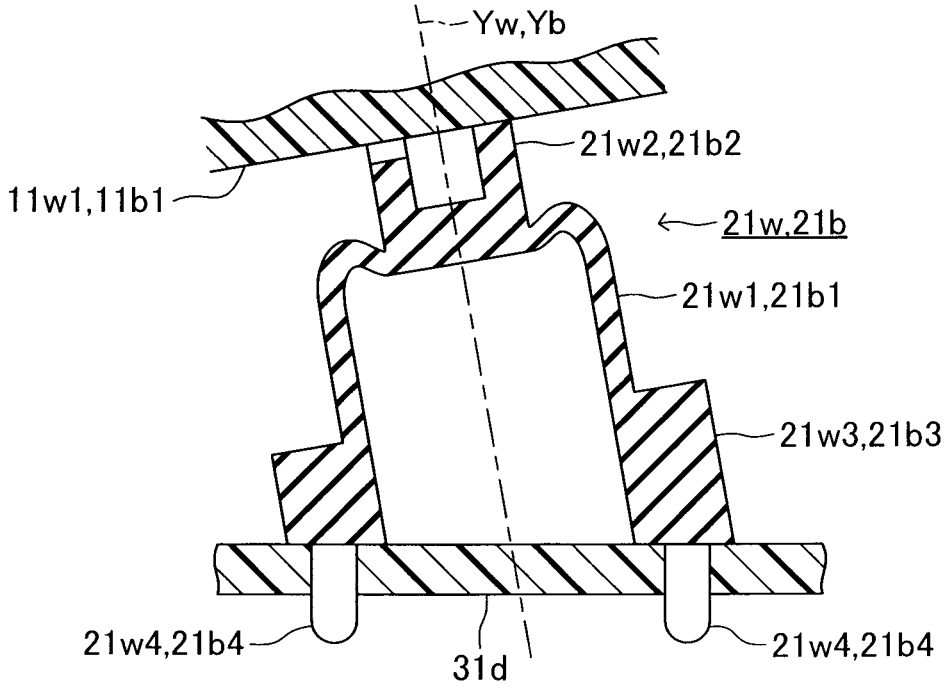
FIG. 4(B) is a cross sectional view of the reaction force generation member at a point in time when the reaction force generation member starts buckling and deforming.
Figure 14:
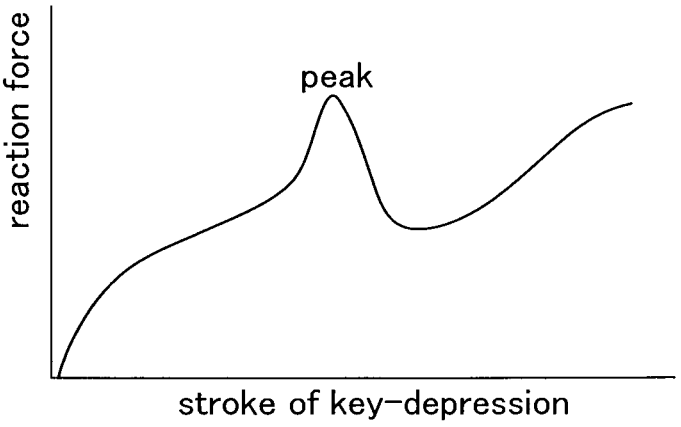
FIG. 14 is a graph indicating characteristics of reaction force of the reaction force generation member against a key-depression stroke.

Hereafter, the reaction force generation members 21*w* and 21*b* will be explained. Each of the reaction force generation members 21*w* and 21*b* is integrally formed of elastic rubber. As indicated in FIGS. 4(A) and (B), more specifically, the reaction force generation members 21*w* are 21*b* are configured by body portions 21*w*1 and 21*b*1, top portions 21*w*2 and 21*b*2, base portions 21*w*3 and 21*b*3, and pairs of leg portions 21*w*4 and 21*b*4, respectively. Each of the body portions 21*w*1 and 21*b*1 is shaped like a dome (a bowl) which is deformable by depression from above. Furthermore, the body portions 21*w*1 and 21*b*1 are thin so that the body portions 21*w*1 and 21*b*1 can buckle to be deformed by a depression from above as indicated in FIG. 4(B). As a result, the reaction force generation members 21*w* and 21*b* are elastically deformed by an increasing depression from above to gradually increase a reaction force. After the reaction force has reached its peak, however, the reaction force generation members 21*w* and 21*b* buckle to sharply decrease the reaction force (see FIG. 14).

The top portions 21*w*2 and 21*b*2 are shaped like a cylinder whose upper surface is open and whose lower surface is connected with the upper surface of the body portions 21*w*1 and 21*b*1, respectively. The top portions 21*w*2 and 21*b*2 have a uniform height at all circumferences to have a flat upper surface. At a circumferential part of the upper portion of the top portions 21*w*2 and 21*b*2, a notch is provided so that air can escape between the inside and the outside of the top portions 21*w*2 and 21*b*2. The base portions 21*w*3 and 21*b*3 jut outward from the rim of the lower end of the body portions 21*w*1 and 21*b*1, respectively, to be shaped like a loop (a flange) so that the base portions 21*w*3 and 21*b*3 are thick at all circumferences. Although the base portions 21*w*3 and 21*b*3 have flat upper and lower surfaces, the base portions 21*w*3 and 21*b*3 have heights varying continuously at all circumferences so that the reaction force generation members 21*w* and 21*b* can tilt when the reaction force generation members 21*w* and 21*b* are installed. By a depression from above, the top portions 21*w*2 and 21*b*2, and the base portions 21*w*3 and 21*b*3 are hardly deformed. The pairs of leg portions 21*w*4 and 21*b*4 jut downward from the lower surface of the base portions 21*w*3 and 21*b*3, respectively, to be shaped like cylinders in order to be fastened to a supporting portion 31*d* provided on the upper plate portion 31*a* of the key frame 31. In this case, the supporting portion 31*d* is horizontal. Without using the leg portions 21*w*4 and 21*b*4, furthermore, the undersurface of the base portions 21*w*3 and 21*b*3 may be fastened to the upper plate portion 31*a* (the supporting portion 31*d*) of the key frame 31 with an adhesive or the like.

Figure 3:
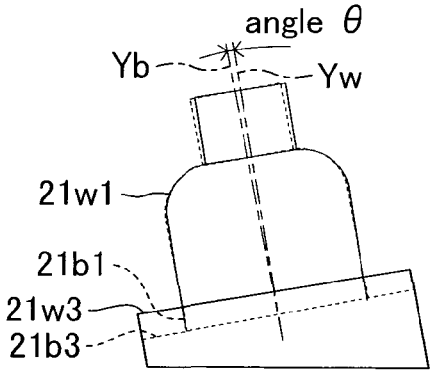
FIG. 3 is an enlarged view of a reaction force generation member of FIG. 1.

The body portions 21*w*1 and 21*b*1, the top portions 21*w*2 and 21*b*2, and the upper portion of the base portions 21*w*3 and 21*b*3 of the reaction force generation members 21*w* and 21*b* configured as above are point-symmetric about axis lines Yw and Yb, respectively. Conversely, the axis lines Yw and Yb are central axes of the body portions 21*w*1 and 21*b*1, and the top portions 21*w*2 and 21*b*2, respectively. Furthermore, the axis lines Yw and Yb are lines of action of force, the lines each passing through the starting point of the reaction force vector to extend in a vector direction. Furthermore, normal lines of the upper surfaces of the top portions 21*w*2 and 21*b*2 and the base portions 21*w*3 and 21*b*3 are parallel to the axis lines Yw or Yb, respectively. As indicated in FIG. 3, however, the base portion 21*w*3 of the reaction force generation member 21*w* of the white key 11*w* is higher than the base portion 21*b*3 of the reaction force generation member 21*b* of the black key 11*b*, while the length of the body portion 21*w*1 of the reaction force generation member 21*w* of the white key 11*w* in the direction of the axis line Yw is shorter than the length of the body portion 21*b*1 of the reaction force generation member 21*b* of the black key 11*b* in the direction of the axis line Yb. Furthermore, the height of the top portion 21*w*2 of the reaction force generation member 21*w* of the white key 11*w* is the same as the height of the top portion 21*b*2 of the reaction force generation member 21*b* of the black key 11*b*, so that the entire height of the reaction force generation member 21*w* of the installed white key 11*w* is roughly the same as the entire height of the reaction force generation member 21*b* of the installed black key 11*b*. In a state where the keys have been installed, furthermore, the axis line Yb of the reaction force generation member 21*b* of the black key 11*b* is inclined toward the horizontal surface slightly more than the axis line Yw of the reaction force generation member 21*w* of the white key 11*w*, which is a feature of the present invention. An angle between the axis lines Yb and Yw is defined as an angle θ.

On the undersurfaces of the white key 11*w* and the black key 11*b*, depression portions 11*w*1 and 11*b*1 for depressing the reaction force generation members 21*w* and 21*b* from above are provided, respectively, such that the depression portions 11*w*1 and 11*b*1 face the upper surfaces of the top portions 21*w*2 and 21*b*2 of the reaction force generation members 21*w* and 21*b*, respectively. Each of the depression portions 11*w*1 and 11*b*1 is shaped like a flat plate, and has an undersurface which is flat and is tilted such that the front side is low, and the rear side is high with respect to the undersurface of the white key 11*w* and the black key 11*b*. The tilting angle of the depression portions 11*w*1 and 11*b*1 is designed, as described in detail later, such that the normal lines of the undersurfaces of the depression portions 11*w*1 and 11*b*1 (straight lines perpendicular to the undersurfaces) become parallel to the axis lines Yw and Yb of the reaction force generation members 21*w* and 21*b* when the reaction forces of the reaction force generation members 21*w* and 21*b* reach their peaks, respectively. At the points in time when the reaction forces of the reaction force generation members 21*w* are 21*b* reach their peaks, respectively, furthermore, the directions in which the reaction forces act coincide with the directions of the axis lines Yw and Yb of the reaction force generation members 21*w* and 21*b*, respectively. Therefore, it can be understood that at the points in time when the reaction forces of the reaction force generation members 21*w* and 21*b* reach their peaks, respectively, the direction in which the reaction force acts is varied between the white key 11*w* and the black key 11*b*, while the directions in which the reaction force generation members 21*w* and 21*b* are depressed at the points in time when the reaction forces of the reaction force generation members 21*w* and 21*b* reach their peaks coincide with the directions in which the reaction force generation members 21*w* and 21*b* exert a reaction force, respectively. In this case, the inclination of the undersurface of the depression portion 11*b*1 of the black key 11*b* against the horizontal surface (the undersurface of the black key 11*b*) is slightly greater than the inclination of the undersurface of the depression portion 11*w*1 of the white key 11*w* against the horizontal surface (the undersurface of the white key 11*w*). The respective undersurfaces of the depression portions 11w1 and 11b1 may not be flat but may be spherical as long as the normal lines of the undersurfaces including respective depression points of the depression portions 11w1 and 11b1 become parallel to the axis lines Yw and Yb, respectively, at the points in time when the reaction forces reach their peaks, respectively. Furthermore, the depression portions 11w1 and 11b1 may be a rib shaped like a cross, a letter H or the like protruding downward from the inner upper surface of the white key 11w and the black key 11b, respectively.

Furthermore, the keyboard apparatus has a spring 34w for the white key 11w and a spring 34b for the black key 11b. The springs 34w and 34b are provided between the white key 11w and the black key 11b, and the upper plate portion 31a of the key frame 31, respectively, such that the springs 34w and 34b are situated at the midpoint between the depression portions 11w1 and 11wb, and the key supporting portions 32, respectively. The springs 34w and 34b urge the white key 11w and the black key 11b upward, respectively, with respect to the upper plate portion 31a. The springs 34w and 34b may not be a coil, but may be a plate spring as long as the springs can urge the white key 11w and the black key 11b upward.

The white key 11w has an extending portion 11w2 which extends downward from the front end of the white key 11w. At the lower end of the extending portion 11w2, an engagement portion 11w3 jutting frontward is provided such that the engagement portion 11w3 is inserted below the upper plate portion 31a from above through a through-hole provided on the upper plate portion 31a of the key frame 31. On the undersurface of a front end portion of the upper plate portion 31a of the key frame 31, an upper limit stopper member 35w is provided. The upper limit stopper member 35w is a cushioning material such as felt. By coming into contact with the engagement portion 11w3 of the white key 11w, the upper limit stopper member 35w restricts upward displacement of the front end portion of the white key 11w. On the upper surface of the front end portion of the upper plate portion 31a of the key frame 31, a lower limit stopper member 36w is provided. The lower limit stopper member 36w is also a cushioning material such as felt. By coming into contact with the undersurface of the front end portion of the white key 11w, the lower limit stopper member 36w restricts downward displacement of the front end portion of the white key 11w.

The black key 11b has an extending portion 11b2 which extends downward from the front end of the black key 11b. At the lower end of the extending portion 11b2, an engagement portion 11b3 jutting rearward is provided such that the engagement portion 11b3 is inserted below the upper plate portion 31a from above through a through-hole provided on the upper plate portion 31a of the key frame 31. On the undersurface of a middle portion of the upper plate portion 31a of the key frame 31, an upper limit stopper member 35b is provided. The upper limit stopper member 35b is also a cushioning material such as felt. By coming into contact with the engagement portion 11b3 of the black key 11b, the upper limit stopper member 35b restricts upward displacement of the front end portion of the black key 11b. On the upper surface of the middle portion of the upper plate portion 31a of the key frame 31, a lower limit stopper member 36b is provided. The lower limit stopper member 36b is also a cushioning material such as felt. By coming into contact with the undersurface of the front end portion of the black key 11b, the lower limit stopper member 36b restricts downward displacement of the front end portion of the black key 11b.

To the undersurface of the upper plate portion 31a of the key frame 31, electric circuit boards 37 are fastened such that the electric circuit boards 37 are situated slightly behind the reaction force generation members 21w and 21b, respectively, to be parallel to the upper plate portion 31a. To the upper surface of the electric circuit boards 37, dome-shaped key switches 38w and 38b for the white key 11w and the black key 11b are fastened, respectively. The key switches 38w and 38b are changed from an off-state to an on-state by a depression of a jutting portion jutting from the undersurface of the white key 11w and the black key 11b at the time of a depression of a key to detect a user's depression/release of the white key 11w and the black key 11b. The detection of the depression/release of a key by the key switch 38w and 38b is used for control of generation of a musical tone signal.

Next, the operation of the keyboard apparatus according to the first embodiment configured as above will be explained. When a player starts depressing the white key 11w or the black key 11b, the depressed white key 11w or black key 11b starts pivoting about a pivot axis Cw or Cb, resisting a reaction force exerted by the spring 34w or 34b, so that the front end portion of the white key 11w or the black key 11b moves downward to allow the engagement portion 11w3 or 11b3 to be released from the upper limit stopper member 35w or 35b to allow the depression portion 11w1 or 11b1 to come into contact with the rear end of the upper surface of the top portion 21w2 or 21b2 of the reaction force generation member 21w or 21b. If the depressed white key 11w or black key 11b is depressed further, the front end portion of the white key 11w or the black key 11b moves downward, so that the body portion 21w1 or 21b1 of the reaction force generation member 21w or 21b starts being deformed by the depression by the depression portion 11w1 or 11b1. As a result, the player starts recognizing not only the reaction force exerted by the spring 34w or 34b but also the gradually increasing reaction force exerted by the reaction force generation member 21w or 21b (see FIG. 14).

If the depressed white key 11w or black key 11b is depressed further, the reaction force of the reaction force generation member 21w or 21b reaches its peak, so that the body portion 21w1 or 21b1 starts buckling and deforming. As a result, the player can recognize a clear feeling of click. Slightly later than the buckling, furthermore, the key switch 38w or 38b turns from the off-state to the on-state by a depression of the jutting portion jutting from the undersurface of the white key 11w or the black key 11b. In response to the change to the on-state of the key switch 38w or 38b, a musical tone signal generation circuit which is not shown starts generating a musical tone signal.

If the depressed white key 11w or black key 11b is depressed further, the undersurface of the front end portion of the white key 11w or the black key 11b comes into contact with the lower limit stopper member 36w or 36b to stop the pivoting of the white key 11w or the black key 11b. In this state, the elastic deformation of the reaction force generation member 21w or 21b also stops. If the white key 11w or the black key 11b is released, the front end portion of the white key 11w or the black key 11b moves upward because of the reaction forces of the reaction force generation member 21w or 21b and the spring 34w or 34b. In the course during which the front end portion of the white key 11w or the black key 11b moves to return upward, the key switch 38w or 38b changes from the on-state to the off-state, so that the musical tone signal generation circuit which is not shown controls the termination of the generation of the musical tone signal. If the front end portion of the white key 11w or the black key 11b moves upward, furthermore, the engagement portion 11w3 or 11b3 comes into contact with the upper limit stopper member 35w or 35b to allow the white key 11w or the black key 11b to return to the key-release state.

Figure 5A:
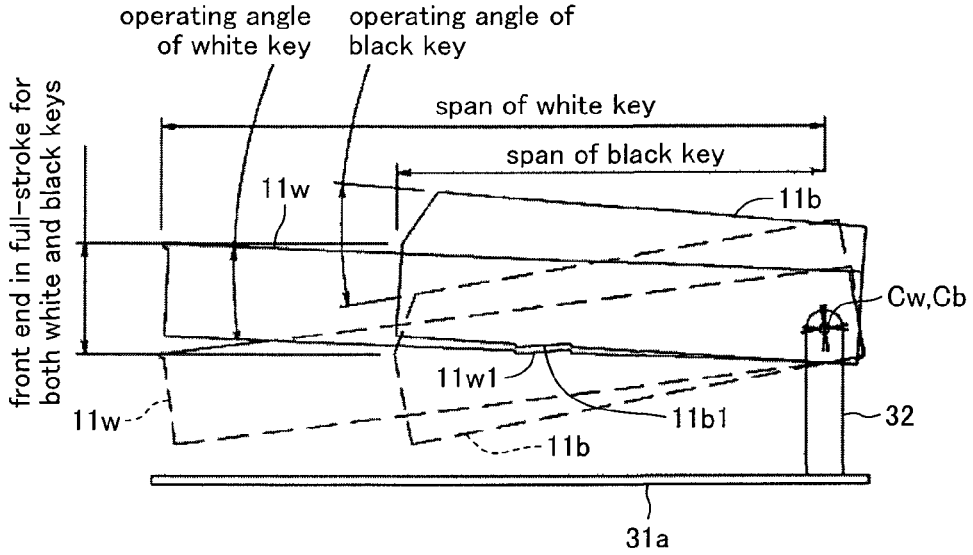
FIGS. 5(A) to (D) are diagrams explaining that a white key and a black key have the same stroke of their front end.
Figure 5B:
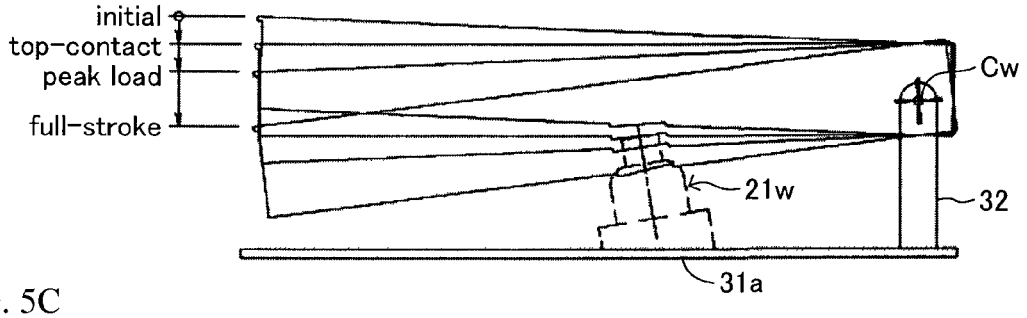
Figure 5C:
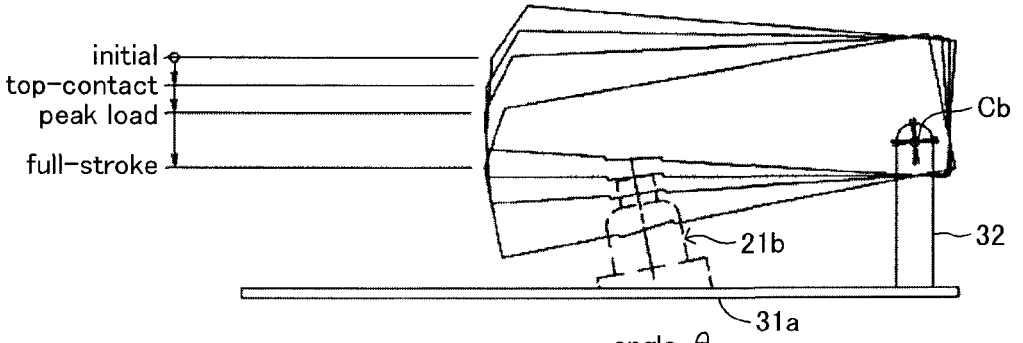
Figure 5D:
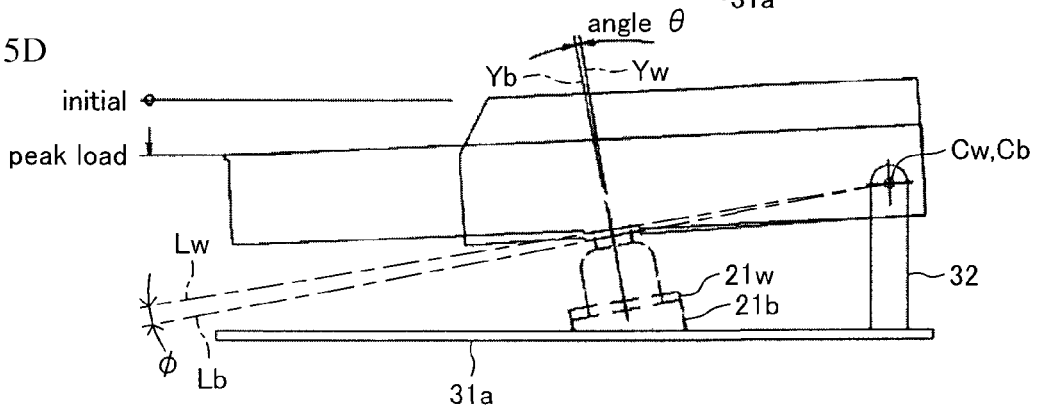

In addition to the operation of the keyboard apparatus, features of the configuration of the keyboard apparatus will now be explained. In FIG. 5(A), the white key 11*w* and the black key 11*b* which are in a state where the upward move of the white key 11*w* and the black key 11*b* is restricted by the upper limit stopper members 35*w* and 35*b* to be in the key-release state are indicated by solid lines, while the white key 11*w* and the black key 11*b* which are in a state where the downward move of the white key 11*w* and the black key 11*b* is restricted by the lower limit stopper members 36*w* and 36*b* to be in a state where the depression of the white key 11*w* and the black key 11*b* has been completed (hereafter referred to as a full-stroke state) are indicated by broken lines. FIG. 5(B) indicates the key-release state (an initial state) of the white key 11*w*, a state where the depression portion 11*w*1 has come into contact with the top portion 21*w*2 of the reaction force generation member 21*w* by a key-depression (hereafter referred to as a top-contact state), a state where the reaction force of the reaction force generation member 21*w* has then reached its peak (hereafter referred to as a peak load state), and the full-stroke state where the key-depression has eventually finished. FIG. 5(C) indicates the black key 11*b* which is in the key-release state (initial state), the top-contact state, the peak load state and the full-stroke state. FIG. 5(D) indicates the white key 11*w* and the black key 11*b* which are in the peak load state.

Figure 6A:
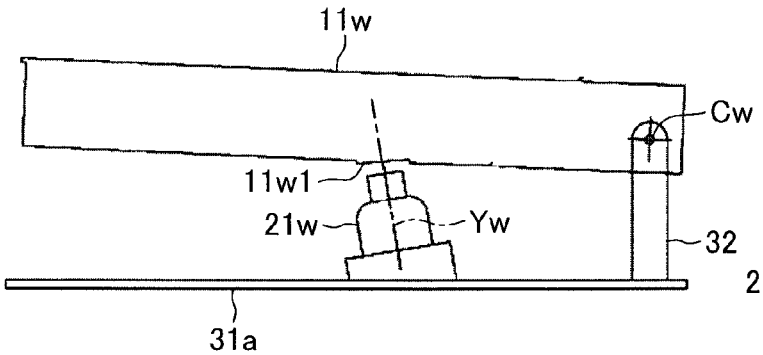
FIGS. 6(A) to (D) are schematic diagrams indicating states ranging from a point in time before the start of a depression of the white key to the end of the depression of the white key.
Figure 6E:
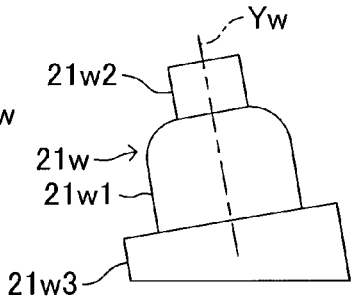
FIG. 6(E) is an enlarged view of the reaction force generation member indicated in FIG. 6(A)
Figure 6B:
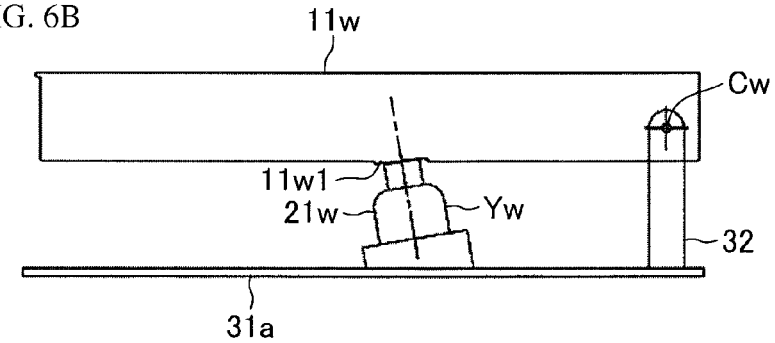
Figure 6F:
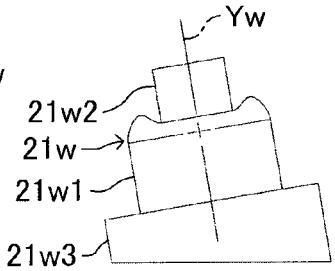
FIG. 6(F) is an enlarged view of the reaction force generation member indicated in FIG. 6(C)
Figure 6C:
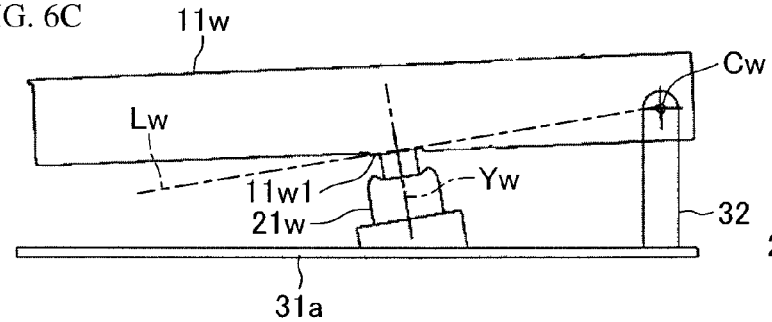
Figure 6D:
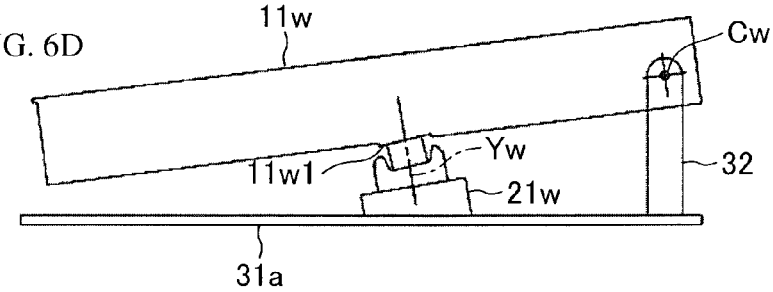
Figure 7A:
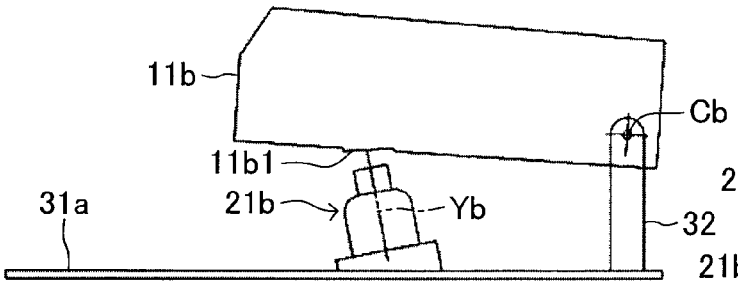
FIGS. 7(A) to (D) are schematic diagrams indicating states ranging from a point in time before the start of a depression of the black key to the end of the depression of the black key.
Figure 7E:
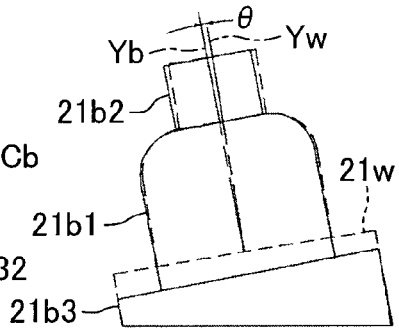
FIG. 7(E) is an enlarged view of the reaction force generation member indicated in FIG. 7(A)
Figure 7B:
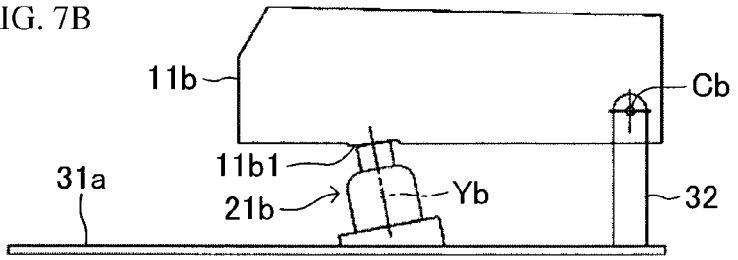
Figure 7F:
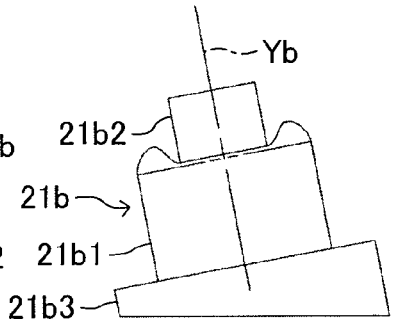
FIG. 7(F) is an enlarged view of the reaction force generation member indicated in FIG. 7(C)
Figure 7C:
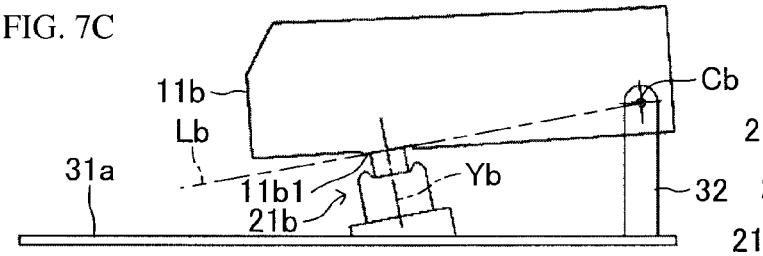
Figure 7D:
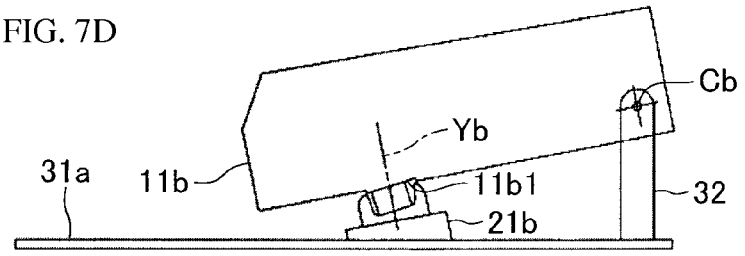

FIGS. 6(A) to (D) indicate the white key 11*w* which is in the key-release state, the top-contact state, the peak load state and the full-stroke state, respectively. FIG. 6(E) is an enlarged view of the reaction force generation member 21*w* shown in FIG. 6(A), while FIG. 6(F) is an enlarged view of the reaction force generation member 21*w* shown in FIG. 6(C). FIGS. 7(A) to (D) indicate the black key 11*b* which is in the key-release state, the top-contact state, the peak load state and the full-stroke state, respectively. FIG. 7(E) is an enlarged view of the reaction force generation member 21*b* shown in FIG. 7(A), while FIG. 7(F) is an enlarged view of the reaction force generation member 21*b* shown in FIG. 7(C). In FIG. 7(E), for comparison between the direction of the axis line Yb of the reaction force generation member 21*b* of the black key 11*b* and the direction of the axis line Yw of the reaction force generation member 21*w* of the white key 11*w*, the reaction force generation member 21*w* is indicated by broken lines. The angle θ is an angle between the axis lines Yb and Yw.

This keyboard apparatus is designed as indicated in FIG. 5(A) such that the front end of the white key 11*w* (the front end of the upper surface of the white key 11*w*) is as high as the front end of the black key 11*b* (the lowest point of an inclined front end portion of the black key 11*b*) in the key-release state and in the full-stroke state. In other words, the keyboard apparatus is designed such that the amount of full-stroke by a key-depression is identical between the white key 11*w* and the black key 11*b*. However, since the black key 11*b* is shorter than the white key 11*w* in the front-rear direction, the black key 11*b* has a greater operating angle than the white key 11*w*. Furthermore, since the pivot axis Cw of the white key 11*w* is situated at the same position as the pivot axis Cb of the black key 11*b* with the depression portion 11*b*1 of the black key 11*b* being situated at the same position as the depression portion 11*w*1 of the white key 11*w* in the front-rear direction, the amount of vertical travel of the depression portion 11*b*1 of the black key 11*b* is greater than the amount of vertical travel of the depression portion 11*w*1 of the white key 11*w*. As described above, therefore, the keyboard apparatus is designed such that the base portion 21*b*3 of the reaction force generation member 21*b* of the black key 11*b* is lower than the base portion 21*w*3 of the reaction force generation member 21*w* of the white key 11*w* with the body portion 21*b*1 of the reaction force generation member 21*b* of the black key 11*b* being longer than the body portion 21*w*1 of the reaction force generation member 21*w* of the white key 11*w* in the direction of the axis lines Yb and Yw so that the amount of deformation of the reaction force generation member 21*b* can be greater than the amount of deformation of the reaction force generation member 21*w*.

In the top-contact state and in the peak load state, as indicated in FIG. 5(B) and FIG. 5(C), the front end (the front end of the upper surface) of the white key 11*w* is roughly as high as the front end (the lowest point of the inclined front end portion) of the black key 11*b*. As described above, furthermore, since the amount of vertical travel of the depression portion 11*b*1 of the black key 11*b* is greater than the amount of vertical travel of the depression portion 11*w*1 of the white key 11*w*, the keyboard apparatus is designed such that the depression portion 11*b*1 of the black key 11*b* is located at a higher position than the depression portion 11*w*1 of the white key 11*w* in the key-released state. In the key-release state, however, the black key 11*b* and the white key 11*w* are inclined against the horizontal surface such that the front end is slightly higher than the rear end.

In the peak load state, as described above, since the front end of the white key 11*w* is roughly as high as the front end of the black key 11*b*, the angle of rotation of the black key 11*b* is greater than the angle of rotation of the white key 11*w*, with the direction of rotation of the depression portion 11*b*1 of the black key 11*b* being inclined slightly greater than the direction of rotation of the depression portion 11*w*1 of the white key 11*w* toward the horizontal surface as indicated in FIG. 5(D). In other words, the direction in which the depression portion 11*b*1 of the black key 11*b* depresses the reaction force generation member 21*b* is inclined toward the horizontal surface more than the direction in which the depression portion 11*w*1 of the white key 11*w* depresses the reaction force generation member 21*w* by an angle ϕ. The angle ϕ is an angle between the shown straight lines Lb and Lw. The straight line Lb is a line which is situated on a plane orthogonal to the pivot axis Cb of the black key 11*b*, and passes through a depression point of the reaction force generation member 21*b* depressed by the black key 11*b* and the pivot axis Cb of the black key 11*b* in the peak load state. The straight line Lw is a line which is situated on a plane orthogonal to the pivot axis Cw of the white key 11*w*, and passes through a depression point of the reaction force generation member 21*w* depressed by the white key 11*w* and the pivot axis Cw of the white key 11*w* in the peak load state.

As described above, furthermore, the axis line Yb of the reaction force generation member 21*b* of the black key 11*b* is inclined slightly greater than the axis line Yw of the reaction force generation member 21*w* of the white key 11*w* toward the horizontal surface, with the angle between the axis lines Yb and Yw being defined as θ (see FIG. 7(E)). Furthermore, the first embodiment is designed such that the angle θ between the axis lines Yb and Yw is equal to the angle ϕ between the straight lines Lb and Lw. Therefore, the reaction force generation members 21*w* and 21*b* are depressed in the directions of the axis lines Yw and Yb by the pivoting white key 11*w* and black key 11*b*, respectively, in the peak load state. Furthermore, an inclined angle of the undersurface of the depression portion 11*w*1 of the white key 11*w* is adjusted such that a normal line of the undersurface of the depression portion 11*w*1 (a line perpendicular to the undersurface) becomes parallel to the axis line Yw of the reaction force generation member 21*w* in the peak load state so that the entire upper surface of the top portion 21*w*2 of the reaction force generation member 21*w* can be depressed evenly. Furthermore, an inclined angle of the undersurface of the depression portion 11*b*1 of the black key 11*b* is adjusted such that a normal line of the undersurface of the depression portion 11*b*1 (a line perpendicular to the undersurface) becomes parallel to the axis line Yb of the reaction force generation member 21*b* in the peak load state so that the entire upper surface of the top portion 21*b*2 of the reaction force generation member 21*b* can be depressed evenly. However, the inclined angle of the undersurface of the depression portion 11*w*1 of the white key 11*w* is slightly different from the inclined angle of the undersurface of the depression portion 11*b*1 of the black key 11*b*.

In this peak load state, as a result, the body portions 21*w*1 and 21*b*1 of the reaction force generation members 21*w* and 21*b* are deformed evenly with respect to the axis lines Yw and Yb as indicated in FIG. 6(F) and FIG. 7(F), respectively. In other words, the body portions 21*w*1 and 21*b*1 of the reaction force generation members 21*w* and 21*b* are deformed in parallel in the vertical direction at all circumferences of the axis lines Yw and Yb, respectively.

In the first embodiment, as explained above, the reaction force generation members 21*w* and 21*b* are arranged such that the respective directions of the axis lines Yw and Yb of the reaction force generation members 21*w* and 21*b* are varied between the white key 11*w* and the black key 11*b* so that the depression directions at the point in time when the reaction forces have reached their peaks are close to the axis line directions of the reaction force generation members 21*w* and 21*b*, respectively. Particularly, the first embodiment is designed such that the angle θ between the direction of the axis line Yw of the reaction force generation member 21*w* of the white key 11*w* and the direction of the axis line Yb of the reaction force generation member 21*b* of the black key 11*b* is equal to the angle ϕ between the straight lines Lw and Lb indicative of the respective directions of depression of the white key 11*w* and the black key 11*b*, respectively. As described above, the straight line Lw is the line which is situated on a plane orthogonal to the pivot axis Cw of the white key 11*w*, and passes through the depression point of the reaction force generation member 21*w* depressed by a key-depression of the white key 11*w* in the peak load state and the pivot axis Cw of the white key 11*w*. The straight line Lb is the line which is situated on a plane orthogonal to the pivot axis Cb of the black key 11*b*, and passes through the depression point of the reaction force generation member 21*b* depressed by a key-depression of the black key 11*b* in the peak load state and the pivot axis Cb of the black key 11*b*. According to the first embodiment, therefore, at the time of the depression of the white key 11*w* and the black key 11*b*, the reaction force generation members 21*w* and 21*b* corresponding to the white key 11*w* and the black key 11*b* are to be depressed roughly in the axis line direction at the point in time when the reaction forces reach their respective peaks immediately before buckling of the reaction force generation members 21*w* and 21*b* which are rubber domes, so that the first embodiment can provide the player with favorable key touch having a roughly similar feeling of click both in a depression of the white key 11*w* and in a depression of the black key 11*b*.

In the peak load state of the reaction force generation members 21*w* and 21*b*, as described above, the directions in which the reaction forces of the reaction force generation members 21*w* and 21*b* act coincide with the axis lines Yw and Yb, respectively. Therefore, the above-described feature can be understood from a different viewpoint as follows. That is, the first embodiment is configured such that the direction in which the reaction force acts in the peak load state of the reaction force generation members 21*w* and 21*b* is varied between the white key 11*w* and the black key 11*b* in order to allow the directions in which the reaction force generation members 21*w* and 21*b* are depressed in the peak load state coincide with the directions in which the reaction force generation members 21*w* and 21*b* generate a reaction force, respectively. By such a configuration of the first embodiment, as a result, the player can perceive the favorable key touch having the roughly similar feeling of click both in a depression of the white key 11*w* and in a depression of the black key 11*b*.

Furthermore, the first embodiment is configured such that the respective normal lines of the depression surfaces of the depression portions 11*w*1 and 11*b*1 of the white key 11*w* and the black key 11*b* become parallel to the axis lines Yw and Yb of the reaction force generation members 21*w* and 21*b*, respectively, in the peak load state. By this configuration, the reaction force generation members 21*w* and 21*b* are to be depressed more effectively. As a result, the keyboard apparatus can provide the player with more favorable key touch.

Furthermore, the first embodiment is designed such that the angle θ is equal to the angle ϕ. However, the respective pivoting angles of the white key 11*w* and the black key 11*b* are not so great, while the angles of rotation of the depression portions 11*w*1 and 11*b*1 are not so great. Therefore, as long as the angle θ is set to be within a range which is 0 or more, and is smaller than an angle 2ϕ which is double the angle ϕ, the range is acceptable because the directions in which the depression portions 11*w*1 and 11*b*1 depress the reaction force generation members 21*w* and 21*b* in the peak load state, respectively, is almost the same. This can be also understood from a different viewpoint that the angle θ is set such that the directions in which the reaction force generation members 21*w* and 21*b* are depressed in the peak load state fall within the acceptable range with respect to the directions in which the reaction force generation members 21*w* and 21*b* generate a reaction force. Therefore, even if the angle θ is set at a value which is 0 or more, and is smaller than the angle 2ϕ, the keyboard apparatus can provide the player with favorable key touch. In this case as well, furthermore, it is preferable that in order to allow the reaction force generation members 21*w* and 21*b* to be depressed effectively, the respective inclinations of the depression portions 11*w*1 and 11*b*1 are adjusted such that the normal lines of the depression surfaces of the depression portions 11*w*1 and 11*b*1 of the white key 11*w* and the black key 11*b* become parallel to the axis lines Yw and Yb of the reaction force generation members 21*w* and 21*b* in the peak load state, respectively.

a1. Modification of the First Embodiment

Figure 8:
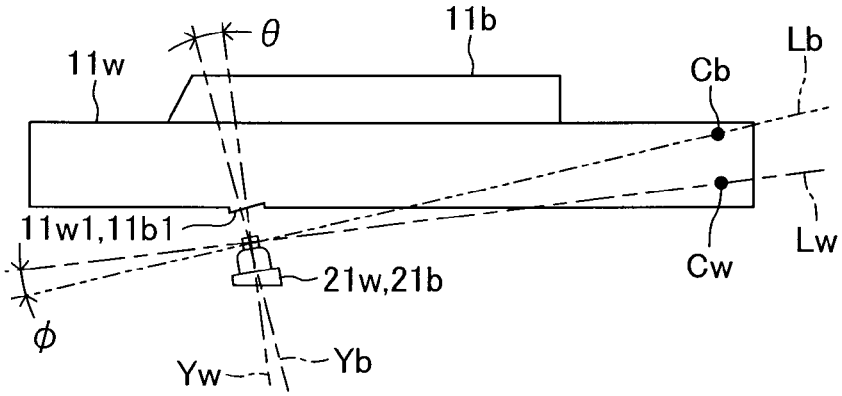
FIG. 8 is a schematic side view of a keyboard apparatus according to the first modification of the first embodiment.

Next, the first modification of the above-described first embodiment will be explained with reference to FIG. 8. The first modification is configured such that the pivot axis Cb of the black key 11*b* is situated above the pivot axis Cw of the white key 11*w*. However, the pivot axis Cb of the black key 11*b* is located at the same position in the front-rear direction as the pivot axis Cw of the white key 11*w*. Since the other configuration of the first modification is similar to that of the first embodiment, the explanation of the first modification will be omitted. In the first modification as well, the straight lines Lw and Lb provided for the white key 11*w* and the black key 11*b*, respectively, and the axis lines Yw and Yb of the reaction force generation members 21*w* and 21*b* are defined as indicated in the figure, while the above-described angles θ and ϕ are also defined as indicated in the figure.

Figure 9:
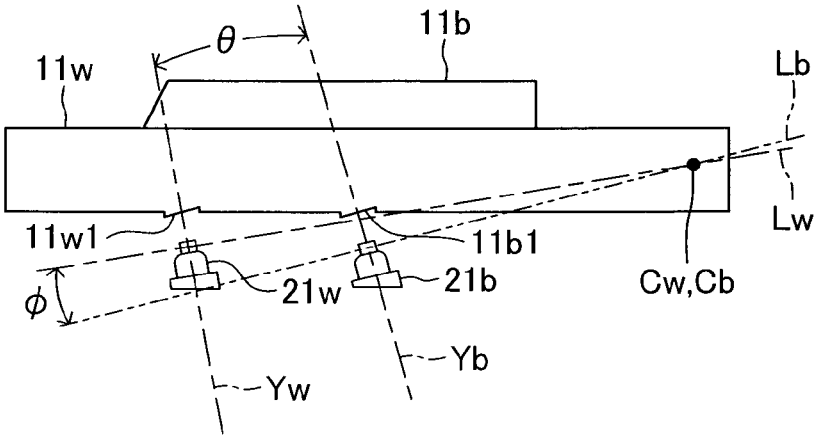
FIG. 9 is a schematic side view of a keyboard apparatus according to the second modification of the first embodiment.
Figure 10:
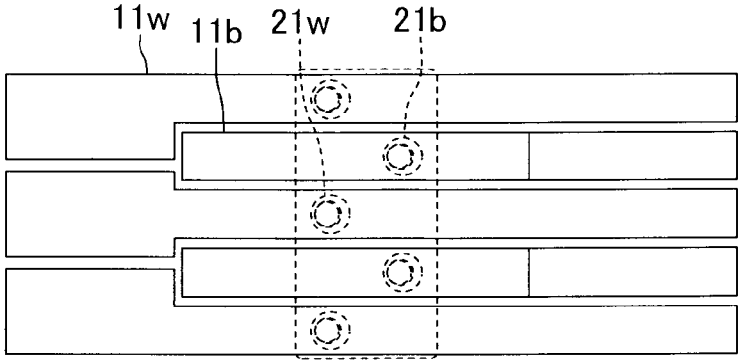
FIG. 10 is a schematic top view of the keyboard apparatus of FIG. 9.

Next, the second modification of the first embodiment will be explained with reference to FIG. 9. The second modification is configured such that the reaction force generation member 21*b* of the black key 11*b* is situated behind the reaction force generation member 21*w* of the white key 11*w*. In the second modification, furthermore, the depression portion 11*b*1 of the black key 11*b* is provided to face the reaction force generation member 21*b*, with the depression portion 11*w*1 of the white key 11*w* being provided to face the reaction force generation member 21*w*. The pivot axis Cb of the black key 11*b* is located at the same position in the front-rear direction and in the vertical direction as the pivot axis Cw of the white key 11*w*. Since the other configuration of the second modification is similar to that of the first embodiment, the explanation of the second modification will be omitted. In the second modification as well, the straight lines Lw and Lb provided for the white key 11*w* and the black key 11*b*, respectively, and the axis lines Yw and Yb of the reaction force generation members 21*w* and 21*b* are defined as indicated in the figure, while the above-described angles θ and ϕ are also defined as indicated in the figure. As indicated in FIG. 10, furthermore, the second modification is configured such that the reaction force generation members 21*w* and 21*b* each of which is formed of a rubber dome are integrally configured to be arranged in two rows in the front-rear direction.

Figure 11:
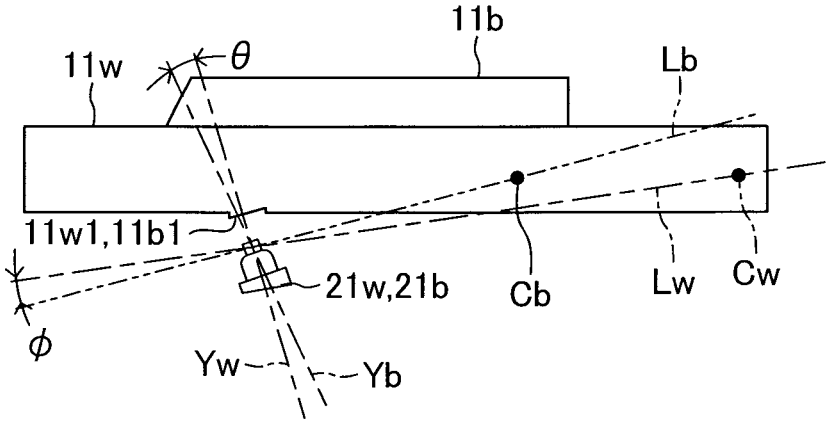
FIG. 11 is a schematic side view of a keyboard apparatus according to the third modification of the first embodiment.

Next, the third modification of the above-described first embodiment will be explained with reference to FIG. 11. The third modification is configured such that the pivot axis Cb of the black key 11*b* is situated in front of the pivot axis Cw of the white key 11*w*. However, the pivot axis Cb of the black key 11*b* is located at the same position in the vertical direction as the pivot axis Cw of the white key 11*w*. Since the other configuration of the third modification is similar to that of the first embodiment, the explanation of the third modification will be omitted. In the third modification as well, the straight lines Lw and Lb provided for the white key 11*w* and the black key 11*b*, respectively, and the axis lines Yw and Yb of the reaction force generation members 21*w* and 21*b* are defined as indicated in the figure, while the above-described angles θ and ϕ are also defined as indicated in the figure.

The third modification may be modified such that the pivot axis Cw of the white key 11*w* is situated in front of the pivot axis Cb of the black key 11*b*. Furthermore, the respective positions of the pivot axis Cb of the black key 11*b* and the pivot axis Cw of the white key 11*w* may be varied in the vertical direction, or the respective positions of the reaction force generation member 21*b* of the black key 11*b* and the reaction force generation member 21*w* of the white key 11*w* may be varied in the front-rear direction.

In the first to third modifications as well, the direction in which the depression portion 11*w*1 of the white key 11*w* and the depression portion 11*b*1 of the black key 11*b* rotate in the peak load state varies with each other, while the direction in which the reaction force generation members 21*w* and 21*b* are depressed in the peak load state varies with each other. As indicated in FIG. 8, FIG. 9 and FIG. 11, therefore, the first to third modifications are configured such that the reaction force generation members 21*w* and 21*b* are fastened to the upper plate portion 31*a* of the key frame 31, with the direction of the axis line being varied between the axis line Yw of the reaction force generation member 21*w* and the axis line Yb of the reaction force generation member 21*b*. Furthermore, the angle θ between the axis lines Yw and Yb is set to be equal to the angle ϕ between the straight lines Lw and Lb. According to the first to third modifications as well, therefore, by the depression of the white key 11*w* and the black key 11*b*, at the point in time when the reaction forces reach their respective peaks immediately before buckling of the reaction force generation members 21*w* and 21*b* which are rubber domes, the reaction force generation members 21*w* and 21*b* corresponding to the white key 11*w* and the black key 11*b* are to be depressed roughly in the axis line direction so that the first to third modifications can provide the player with favorable key touch having the similar feeling of click both in the depression of the white key 11*w* and in the depression of the black key 11*b*.

In the first to third modifications as well, furthermore, it is preferable that in order to allow the reaction force generation members 21*w* and 21*b* to be depressed effectively, the respective inclinations of the depression portions 11*w*1 and 11*b*1 are adjusted such that the normal lines of the depression surfaces of the depression portions 11*w*1 and 11*b*1 of the white key 11*w* and the black key 11*b* become parallel to the axis lines Yw and Yb of the reaction force generation members 21*w* and 21*b* in the peak load state, respectively.

In the first to third modifications as well, furthermore, the respective pivoting angles of the white key 11*w* and the black key 11*b* are not so great, while the angles of rotation of the depression portions 11*w*1 and 11*b*1 are not so great. Therefore, the angle θ may be set to be within the range which is 0 or more, and is smaller than the angle 2ϕ which is double the angle ϕ. By such a configuration as well, the keyboard apparatus can provide the player with favorable key touch. In this configuration as well, furthermore, it is preferable that in order to allow the reaction force generation members 21*w* and 21*b* to be depressed effectively, the respective inclinations of the depression portions 11*w*1 and 11*b*1 are adjusted such that the normal lines of the depression surfaces of the depression portions 11*w*1 and 11*b*1 of the white key 11*w* and the black key 11*b* become parallel to the axis lines Yw and Yb of the reaction force generation members 21*w* and 21*b* in the peak load state, respectively.

b. Second Embodiment

Figure 12:
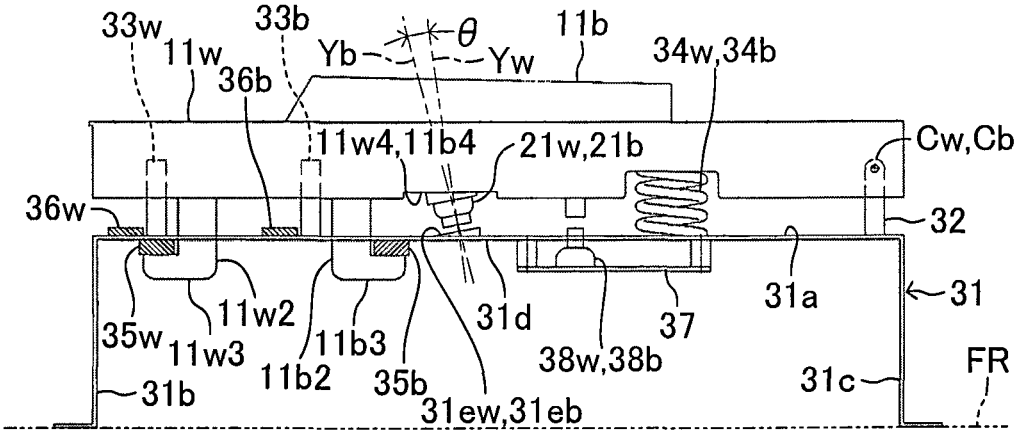
FIG. 12 is a schematic side view of a keyboard apparatus according to the second embodiment of the present invention.

The first embodiment and its modifications are configured such that the white key 11*w* and the black key 11*b* are provided with the depression portion 11*w*1 and 11*b*1, respectively, while the reaction force generation members 21*w* and 21*b* are fastened to the supporting portion 31*d* provided on the upper plate portion 31*a* of the key frame 31. In the first embodiment and its modifications, furthermore, by the depression of the white key 11*w* and the black key 11*b*, the top portions 21*w*2 and 21*b*2 of the reaction force generation members 21*w* and 21*b* are depressed with the depression portion 11*w*1 and 11*b*1, respectively. Instead of such a configuration, however, the reaction force generation members 21*w* and 21*b* may be provided on the white key 11*w* and the black key 11*b*, respectively. FIG. 12 indicates a keyboard apparatus according to the second embodiment in which the reaction force generation members 21*w* and 21*b* are provided on the white key 11*w* and the black key 11*b*, respectively.

As for this keyboard apparatus, supporting portions 11*w*4 and 11*b*4 are provided on the undersurface of the white key 11*w* and the black key 11*b*, respectively, while the reaction force generation members 21*w* and 21*b* are provided on the supporting portions 11*w*4 and 11*b*4, respectively, such that the reaction force generation members 21*w* and 21*b* are inclined. The supporting portions 11*w*4 and 11*b*4 are provided horizontally. In this case, the reaction force generation members 21*w* and 21*b* are formed of body portions 21*w*1 and 21*b*1, the top portions 21*w*2 and 21*b*2, and the base portions 21*w*3 and 21*b*3, respectively, which are similar to those of the first embodiment. In this case, however, the plurality of reaction force generation members 21*w* and 21*b* are not configured integrally, but are configured separately. At positions situated on the upper plate portion 31*a* of the key frame 31 to be opposed to the reaction force generation members 21*w* and 21*b*, depression portions 31*ew* and 31*eb* for depressing the undersurface (equivalent to the upper surface in the first embodiment) of the top portions 21*w*2 and 21*b*2 of the reaction force generation members 21*w* and 21*b* are provided, respectively. In this case as well, the axis lines Yw and Yb of the reaction force generation members 21*w* and 21*b* are inclined against the vertical position such that the upper side of the axis lines is inclined toward the front. The respective upper surfaces of the depression portions 31*ew* and 31*eb* are inclined against the horizontal surface such that the front side of the upper surfaces is lower than the rear side. Since the other configuration of the second embodiment is similar to the first embodiment, components of the second embodiment are given the same numerals as those of the first embodiment to omit their explanations.

In the second embodiment as well configured as above, by the depression and release of the white key 11*w* and the black key 11*b*, the white key 11*w* and the black key 11*b* operate similarly to those of the above-described first embodiment. Unlike the first embodiment, however, the reaction force generation members 21*w* and 21*b* are fastened to the white key 11*w* and the black key 11*b*, respectively. Therefore, the reaction force generation members 21*w* and 21*b* move integrally with the white key 11*w* and the black key 11*b*, respectively. When the reaction force generation members 21*w* and 21*b* move downward, the reaction force generation members 21*w* and 21*b* are depressed by the depression portions 31*ew* and 31*eb*, respectively, provided on the upper plate portion 31*a* of the key frame 31. Except the above, the second embodiment operates similarly to the first embodiment.

The second embodiment is also configured such that the direction of the axis line is varied between the axis line Yw of the reaction force generation member 21*w* and the axis line Yb of the reaction force generation member 21*b*, with the angle θ between the axis lines Yw and Yb being set to be equal to the angle ϕ between the straight lines Lw and Lb which are similar to those of the first embodiment. According to the second embodiment as well, therefore, by the depression of the white key 11*w* and the black key 11*b*, at the point in time when the reaction forces reach their respective peaks immediately before buckling of the reaction force generation members 21*w* and 21*b* which are rubber domes, the reaction force generation members 21*w* and 21*b* corresponding to the white key 11*w* and the black key 11*b*, respectively, are to be depressed in the axis line direction, so that the second embodiment can provide the player with favorable key touch having the similar feeling of click both in the depression of the white key 11*w* and in the depression of the black key 11*b*.

In the second embodiment as well, furthermore, in order to allow the reaction force generation members 21*w* and 21*b* to be depressed effectively, the respective inclinations of the depression portions 31*ew* and 31*eb* are adjusted such that the normal lines of the depression surfaces of the depression portions 31*ew* and 31*eb* become parallel to the axis lines Yw and Yb of the reaction force generation members 21*w* and 21*b* in the peak load state, respectively.

In the second embodiment as well, furthermore, the respective pivoting angles of the white key 11*w* and the black key 11*b* are not so great, while the angles of rotation of the depression portions 31*ew* and 31*eb* are not so great. Therefore, the angle θ may be set to be within the range which is 0 or more, and is smaller than the angle 2ϕ which is double the angle ϕ. By such a configuration as well, the keyboard apparatus can provide the player with favorable key touch. In this configuration as well, furthermore, it is preferable that in order to allow the reaction force generation members 21*w* and 21*b* to be depressed effectively, the respective inclinations of the depression portions 31*ew* and 31*eb* are adjusted such that the normal lines of the depression surfaces of the depression portions 31*ew* and 31*eb* corresponding to the white key 11*w* and the black key 11*b* become parallel to the axis lines Yw and Yb of the reaction force generation members 21*w* and 21*b* in the peak load state, respectively.

The second embodiment may be modified, similarly to the first to third modifications of the first embodiment, such that the respective positions of the pivot axes Cw and Cb of the white key 11*w* and the black key 11*b* are varied in the vertical direction or in the front-rear direction. Furthermore, the respective positions of the reaction force generation members 21*w* and 21*b* in the front-rear direction may be varied between the white key 11*w* and the black key 11*b*.

c. Third Embodiment

Figure 13:
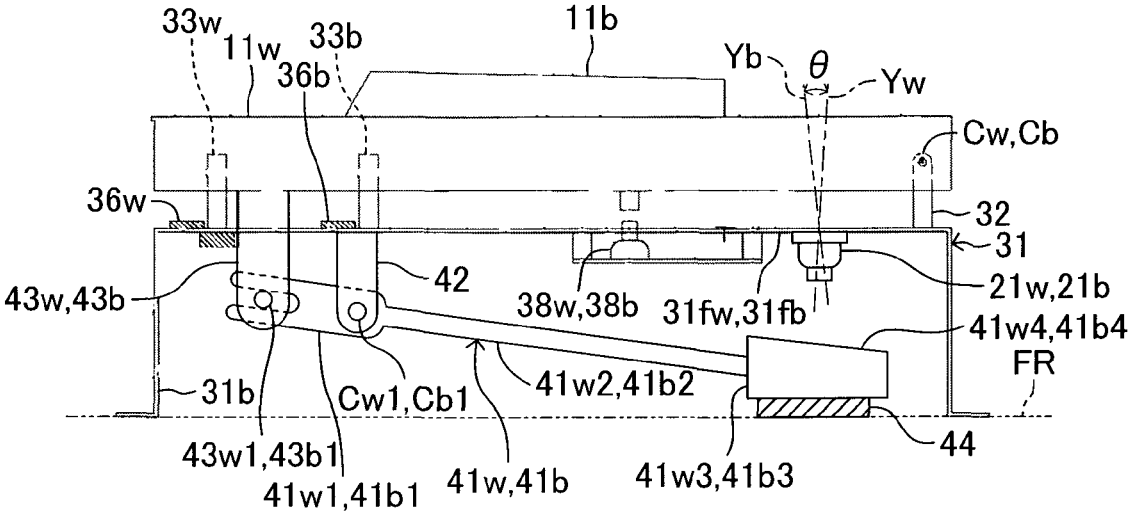
FIG. 13 is a schematic side view of a keyboard apparatus according to the third embodiment of the present invention.

Next, the third embodiment in which pivoting bodies which pivot in conjunction with pivoting of the white key 11*w* and the black key 11*b* depress the reaction force generation members 21*w* and 21*b* will be explained. FIG. 13 indicates a keyboard apparatus according to the third embodiment. The keyboard apparatus has hammers 41*w* and 41*b* which are the above-described pivoting bodies such that the hammers 41*w* and 41*b* correspond to the white key 11*w* and the black key 11*b*, respectively.

The hammers 41*w* and 41*b* are supported by hammer supporting members 42 provided for the respective white key 11*w* and black key 11*b* so that the hammers 41*w* and 41*b* can pivot. Each of the hammer supporting member 42 extends downward from the undersurface of the upper plate portion 31*a* such that the hammer supporting member 42 is situated at the middle of the white key 11*w* and the black key 11*b* in the front-rear direction. The hammers 41*w* and 41*b* are formed of base portions 41*w*1 and 41*b*1, connecting rods 41*w*2 and 41*b*2, and mass bodies 41*w*3 and 41*b*3, respectively. The base portions 41*w*1 and 41*b*1 are supported at the middle portion thereof by the hammer supporting members 42 so that the hammers 41*w* and 41*b* can pivot about the pivot axis Cw1 and Cb1, respectively. More specifically, the mass bodies 41*w*3 and 41*b*3 pivot up and down. Each of the base portions 41*w*1 and 41*b*1 has bifurcated legs at the front portion. Between the legs, drive shafts 43*w*1 and 43*b*1 provided on extending portions 43*w* and 43*b* extending vertically from the undersurface of the white key 11*w* and the black key 11*b* penetrate so that the drive shafts 43*w*1 and 43*b*1 can slide, respectively. The extending portions 43*w* and 43*b* penetrate through a throughhole provided on the upper plate portion 31*a* so that the extending portions 43*w* and 43*b* can be displaced up and down. As a result, the respective front ends of the base portions 41*w*1 and 41*b*1 are to be displaced downward when the white key 11*w* and the black key 11*b* are depressed. The connecting rods 41*w*2 and 41*b*2 extend in the front-rear direction to connect the base portions 41*w*1 and 41*b*1 with the mass bodies 41*w*3 and 41*b*3, respectively. The mass bodies 41*w*3 and 41*b*3 urge the respective front ends of the hammers 41*w* and 41*b* upward, using the mass of the mass bodies 41*w*3 and 41*b*3, respectively.

Below each of the mass bodies 41*w*3 and 41*b*3, an upper limit stopper member 44 for preventing the mass bodies 41*w*3 and 41*b*3 from moving downward is fastened to the frame FR. The upper limit stopper member 44 is also made of a cushioning material such as felt. In the key-release state, therefore, the mass bodies 41*w*3 and 41*b*3 are situated on the upper limit stopper member 44 in order to restrict upward move of the front end of the white key 11*w* and the black key 11*b*. Therefore, the keyboard apparatus of the third embodiment does not have the upper limit stopper members 35*w* and 35*b*, and the extending portions 11*w*2 and 11*b*2 provided for the first embodiment.

The reaction force generation members 21*w* and 21*b* are fastened to the respective undersurfaces of supporting portions 31*fw* and 31*fb* provided on the upper plate portion 31*a* such that the reaction force generation members 21*w* and 21*b* are opposed to the mass bodies 41*w*3 and 41*b*3, respectively. The respective upper surfaces of the mass bodies 41*w*3 and 41*b*3 serve as flat depression portion 41*w*4 and 41*b*4, respectively, to face the undersurfaces (equivalent to the upper surfaces of the first embodiment) of the top portions 21*w*2 and 21*b*2 of the reaction force generation members 21*w* and 21*b* in the key-release state. When the keys are depressed, the depression portions 41*w*4 and 41*b*4 move upward to come into contact with the undersurface of the top portions 21*w*2 and 21*b*2 to depress the reaction force generation members 21*w* and 21*b*, respectively. In this case as well, the reaction force generation members 21*w* and 21*b* are elastically deformed by the depression to buckle after the reaction forces reach their peaks, respectively. Furthermore, since the hammers 41*w* and 41*b* exert a reaction force against the depression of the white key 11*w* and the black key 11*b*, respectively, the keyboard apparatus of the third embodiment may have the springs 34*w* and 34*b* provided for the first embodiment, but does not have the springs 34*w* and 34*b* in the third embodiment. Since the other configuration of the third embodiment is similar to the first embodiment, components of the third embodiment are given the same numerals as those of the first embodiment to omit their explanations.

According to the third embodiment configured as above, when the white key 11*w* and the black key 11*b* are depressed, the drive shafts 43*w*1 and 43*b*1 of the extending portions 43*w* and 43*b* move downward, so that the hammers 41*w* and 41*b* pivot about the pivot axes Cw1 and Cb1 in the counterclockwise direction, respectively. Then, the depression portions 41*w*4 and 41*b*4 of the mass bodies 41*w*3 and 41*b*3 of the hammers 41*w* and 41*b* depress the reaction force generation members 21*w* and 21*b*, so that the reaction force generation members 21*w* and 21*b* elastically deform to buckle, respectively. If the white key 11*w* and the black key 11*b* are depressed further, the reaction force generation members 21*w* and 21*b* elastically deform further, so that the depressions of the white key 11*w* and the black key 11*b* are finished by the contact between the undersurface of the front end of the white key 11*w* and the black key 11*b* and the lower limit stopper members 36*w* and 36*b*. When the white key 11*w* and the black key 11*b* are depressed, the hammers 41*w* and 41*b*, and the reaction force generation members 21*w* and 21*b* give reaction forces to the player against the depressions.

When the white key 11*w* and the black key 11*b* are released, the hammers 41*w* and 41*b* pivot in the clockwise direction because of the mass of the mass bodies 41*w*3 and 41*b*3, respectively, so that the front end of the white key 11*w* and the black key 11*b* moves upward. If the undersurface of the mass bodies 41*w*3 and 41*b*3 comes into contact with the upper limit stopper member 44, the white key 11*w* and the black key 11*b* stop pivoting, so that the white key 11*w* and the black key 11*b* return to the original key-release state.

The keyboard apparatus according to the third embodiment configured to operate as above is also configured such that the direction of the axis line is varied between the axis line Yw of the reaction force generation member 21*w* and the axis line Yb of the reaction force generation member 21*b*, with the angle θ between the axis lines Yw and Yb being set to be equal to the angle ϕ between the straight lines Lw and Lb which are similar to the first embodiment. In this case, the straight line Lw is a straight line which is situated on a plane orthogonal to the pivot axis Cw1 of the hammer 41*w* of the white key 11*w*, and passes through the depression point of the reaction force generation member 21*w* depressed by the pivoting hammer 41*w* in the peak load state and the pivot axis Cw1 of the hammer 41*w*. The straight line Lb is a straight line which is situated on a plane orthogonal to the pivot axis Cb1 of the hammer 41*b* of the black key 11*b*, and passes through the depression point of the reaction force generation member 21*b* depressed by the pivoting hammer 41*b* in the peak load state and the pivot axis Cb1 of the hammer 41*b*. According to the third embodiment as well, therefore, by the depression of the white key 11*w* and the black key 11*b*, at the point in time when the reaction forces reach their respective peaks immediately before buckling of the reaction force generation members 21*w* and 21*b* which are rubber domes, the reaction force generation members 21*w* and 21*b* corresponding to the white key 11*w* and the black key 11*b* are to be depressed by the hammers 41*w* and 41*b* in the directions of the axis lines Yw, Yb, respectively, so that the third embodiment can provide the player with favorable key touch having the similar feeling of click both in the depression of the white key 11*w* and in the depression of the black key 11*b*.

In the third embodiment as well, furthermore, in order to allow the reaction force generation members 21*w* and 21*b* to be depressed effectively, the respective inclinations of the depression portions 41*w*4 and 41*b*4 are adjusted such that the normal lines of the depression surfaces of the depression portions 41*w*4 and 41*b*4 become parallel to the axis lines Yw and Yb of the reaction force generation members 21*w* and 21*b* in the peak load state, respectively.

In the third embodiment as well, furthermore, the respective pivoting angles of the hammers 41*w* and 41*b* are not so great, while the angles of rotation of the depression portions 41*w*4 and 41*b*4 are not so great. Therefore, the angle θ may be set to be within the range which is 0 or more, and is smaller than the angle 2ϕ which is double the angle ϕ. By such a configuration as well, the keyboard apparatus can provide the player with favorable key touch. In this configuration as well, furthermore, it is preferable that in order to allow the reaction force generation members 21*w* and 21*b* to be depressed effectively, the respective inclinations of the depression portions 41*w*4 and 41*b*4 are adjusted such that the normal lines of the depression surfaces of the depression portions 41*w*4 and 41*b*4 become parallel to the axis lines Yw and Yb of the reaction force generation members 21*w* and 21*b* in the peak load state, respectively.

The third embodiment may be modified such that instead of the case of the white key 11*w* and the black key 11*b* of the first to third modifications of the first embodiment, the respective positions of the pivot axes CM and Cb1 of the hammers 41*w* and 41*b* are varied in the vertical direction or in the front-rear direction. Alternatively, the respective positions of the reaction force generation members 21*w* and 21*b* in the front-rear direction may be varied between the white key 11*w* and the black key 11*b*.

Similarly to the second embodiment, furthermore, the keyboard apparatus having the hammers 41*w* and 41*b* may be modified such that the reaction force generation members 21*w* and 21*b* are fastened to the respective upper surfaces of the mass bodies 41*w*3 and 41*b*3 of the hammers 41*w* and 41*b*, with depression portions for depressing the respective upper surfaces of the top portions 21*w*2 and 21*b*2 of the reaction force generation members 21*w* and 21*b* being provided on the undersurface of the upper plate portion 31*a* of the key frame 31 which faces the hammers 41*w* and 41*b*, respectively.

d. Other Modifications

The first and second embodiments, and their modifications are configured to vary the height between the base portions 21*w*3 and 21*b*3 of the reaction force generation members 21*w* and 21*b*, that is, the length of the base portions 21*w*3 and 21*b*3 in the direction of the axis lines Yw and Yb at all circumferences in order to incline the axis lines Yw and Yb of the reaction force generation members 21*w* and 21*b* against the vertical direction in a state where the keyboard apparatus has been assembled. Instead of such a configuration, however, the base portions 21*w*3 and 21*b*3 of the reaction force generation members 21*w* and 21*b* may have the same height, that is, the same length in the direction of the axis lines Yw and Yb at all circumferences in order to incline the axis lines Yw and Yb of the reaction force generation members 21*w* and 21*b* against the vertical direction in the assembled state. In this modification, it is preferable to appropriately incline the supporting portions 31*d*, 11*w*4 and 11*b*4 on which the reaction force generation members 21*w* and 21*b* are provided. Furthermore, the third embodiment may be configured to vary the height of the base portions 21*w*3 and 21*b*3 of the reaction force generation members 21*w* and 21*b*, that is, the length of the base portions 21*w*3 and 21*b*3 in the direction of the axis lines Yw and Yb at all circumferences, to have the same length of the base portions 21*w*3 and 21*b*3 in the axis line direction at all circumferences, or to make the supporting portions 31*fw* and 31*fb* horizontal in order to appropriately incline the axis lines Yw and Yb of the reaction force generation members 21*w* and 21*b* against the vertical direction in the assembled state.

The respective pivot axes of the white key 11*w* and the black key 11*b* are not limited to those of the first and second embodiments and their modifications in which the white key 11*w* and the black key 11*b* pivot about the axis of rotation, but may be a hinge-type pivot axis. More specifically, the hinge-type pivot axis is configured such that a plate-like thin portion is provided on the rear end of the white key 11*w* and the black key 11*b* so that the rear end of the thin portion can be supported by a supporting member to allow the white key 11*w* and the black key 11*b* to pivot by elastic deformation of the thin portion. In this modification, however, the pivot axes Cw and Cb slightly vary with the pivoting of the white key 11*w* and the black key 11*b*, respectively. That is, the respective positions of the pivot axes Cw and Cb vary with the passage of time.

The first to third embodiments and their modifications are configured such that the reaction force generation members 21*w* and 21*b* are provided separately from the key switches 38*w* and 38*b*, respectively. Instead of such a configuration, however, the key switches 38*w* and 38*b* may be configured similarly to the reaction force generation members 21*w* and 21*b* so that the key switches 38*w* and 38*b* can be used as a reaction force generation member. In this modification, each of the dome-shaped body portions 21*w*1 and 21*b*1 is to have a two-tier configuration having an inner portion and an outer portion, with a tubular less-deformable switch portion being provided between the inner portion and outer portion. In this modification, more specifically, by deformation of the outer portion, an increasing reaction force is generated against a depression of the key, while a contact provided on a board is opened or closed by the switch portion, with a reaction force against the key-depression being generated by deformation and buckling of the inner portion.

What is claimed is:

1. A keyboard apparatus for an electronic musical instrument, the keyboard apparatus comprising:

a plurality of keys composed of a white key and a black key, each key pivoting about a corresponding pivot axis so that a front end of the key can move up and down, and a plurality of reaction force generation members which are provided for the plurality of keys, respectively, and each of which is depressed by a depression of a corresponding key to generate a reaction force against the depression of the corresponding key, wherein each of the reaction force generation members is made of an elastic body to be shaped like a dome, and is configured to be elastically deformed by being depressed in an axis line direction to increase the reaction force from a beginning with an increasing amount of elastic deformation to buckle after a peak of the reaction force to reduce the reaction force; and the plurality of reaction force generation members are arranged such that the axis line direction of the reaction force generation members is varied between the white key and the black key so that a direction in which each of the reaction force generation members is depressed at the peak of the reaction force is close to the axis line direction of the reaction force generation member.

2. The keyboard apparatus for an electronic musical instrument according to claim 1, wherein the plurality of reaction force generation members are placed to face depression portions of the keys, respectively, so that the reaction force generation members can be depressed by the depression portions of the keys, respectively, or the plurality of reaction force generation members are provided on the plurality of keys, respectively, so that the reaction force generation members can be depressed by depression portions provided to face the reaction force generation members, respectively; and a first angle between the axis line direction of the reaction force generation member corresponding to the white key and the axis line direction of the reaction force generation member corresponding to the black key is set to be smaller than double a second angle between a straight line which is situated on a plane orthogonal to the pivot axis of the white key and passes through a depression point of the reaction force generation member depressed by a depression of the white key at the peak of the reaction force and the pivot axis of the white key, and a straight line which is situated on a plane orthogonal to the pivot axis of the black key and passes through a depression point of the reaction force generation member depressed by a depression of the black key at the peak of the reaction force and the pivot axis of the black key.

3. The keyboard apparatus for an electronic musical instrument according to claim 2, wherein the first angle is set to be equal to the second angle.

4. The keyboard apparatus for an electronic musical instrument according to claim 2, wherein the respective depression portions of the plurality of keys, or the respective depression portions placed to face the plurality of reaction force generation members are configured such that respective normal lines of depression surfaces of the depression portions of the keys, or respective normal lines of depression surfaces of the depression portions placed to face the plurality of reaction force generation members become parallel to the axis lines of the reaction force generation members at respective peaks of the reaction forces, respectively.

5. The keyboard apparatus for an electronic musical instrument according to claim 1, wherein the plurality of reaction force generation members are configured to face respective depression portions of a plurality of pivoting bodies operating in conjunction with the plurality of keys, respectively, so that the reaction force generation members can be depressed by the depression portions of the pivoting bodies, respectively, or the plurality of reaction force generation members are provided on a plurality of pivoting bodies operating in conjunction with the plurality of keys, respectively, so that the reaction force generation members can be depressed by depression portions placed to face the reaction force generation members, respectively; and a first angle between the axis line direction of the reaction force generation member corresponding to the white key and the axis line direction of the reaction force generation member corresponding to the black key is set to be smaller than double a second angle between a straight line which is situated on a plane orthogonal to a pivot axis of the pivoting body corresponding to the white key and passes through a depression point of the reaction force generation member depressed by a pivot of the pivoting body corresponding to the white key at a peak of the reaction force and the pivot axis of the pivoting body corresponding to the white key, and a straight line which is situated on a plane orthogonal to a pivot axis of the pivoting body corresponding to the black key and passes through a depression point of the reaction force generation member depressed by a pivot of the pivoting body corresponding to the black key at a peak of the reaction force and the pivot axis of the pivoting body corresponding to the black key.

6. The keyboard apparatus for an electronic musical instrument according to claim 5, wherein the first angle is set to be equal to the second angle.

7. The keyboard apparatus for an electronic musical instrument according to claim 5, wherein the respective depression portions of the plurality of pivoting bodies, or the respective depression portions placed to face the plurality of reaction force generation members are configured such that respective normal lines of depression surfaces of the depression portions of the pivoting bodies, or respective normal lines of depression surfaces of the depression portions placed to face the plurality of reaction force generation members become parallel to the axis lines of the reaction force generation members at respective peaks of the reaction forces, respectively.

8. A keyboard apparatus for an electronic musical instrument, the keyboard apparatus comprising:

a plurality of keys composed of a white key and a black key, each key pivoting about a corresponding pivot axis so that a front end of the key can move up and down, and a plurality of reaction force generation members which are provided for the plurality of keys, respectively, and each of which is depressed by a depression of a corresponding key to generate a reaction force against the depression of the corresponding key, wherein each of the reaction force generation members is made of an elastic body, and is configured to be elastically deformed by being depressed to increase the reaction force from a beginning with an increasing amount of elastic deformation to buckle after a peak of the reaction force to reduce the reaction force; and the plurality of reaction force generation members are arranged such that a direction in which each of the reaction force generation members exerts a reaction force at the peak of the reaction force is varied between the white key and the black key so that a direction in which each of the reaction force generation members is depressed at the peak of the reaction force is close to the direction in which the reaction force generation member exerts the reaction force.

* * * * *